US010731275B2

(12) United States Patent
Chien et al.

(10) Patent No.: US 10,731,275 B2
(45) Date of Patent: Aug. 4, 2020

(54) SPINNERET ASSEMBLY FOR COMPOSITE SPINNING AND MANUFACTURING METHOD FOR A BIOMASS COMPOSITE FIBER IMPLEMENTING THE SAME

(71) Applicant: National Chung-Shan Institute of Science and Technology, Taoyuan (TW)

(72) Inventors: Sywe-Bin Chien, Taoyuan (TW); Hung-Sung Liu, Taoyuan (TW); Rong-Jinn Shieh, Taoyuan (TW)

(73) Assignee: National Chung-Shan Institute of Science and Technology, Taoyuan (TW)

( * ) Notice: Subject to any disclaimer, the term of this patent is extended or adjusted under 35 U.S.C. 154(b) by 272 days.

(21) Appl. No.: 16/027,360

(22) Filed: Jul. 4, 2018

(65) Prior Publication Data

US 2019/0186048 A1 Jun. 20, 2019

(30) Foreign Application Priority Data

Dec. 14, 2017 (TW) ..... 106143885 A

(51) Int. Cl.

| | |
|---|---|
| ***D01D 4/02*** | (2006.01) |
| ***D01D 5/06*** | (2006.01) |
| ***D01D 10/02*** | (2006.01) |
| ***D01D 10/06*** | (2006.01) |
| ***D01D 5/34*** | (2006.01) |
| *D01F 4/00* | (2006.01) |

(Continued)

(52) U.S. Cl.

CPC ..... *D01D 4/02* (2013.01); *D01D 5/06* (2013.01); *D01D 5/34* (2013.01); *D01D 10/02* (2013.01); *D01D 10/06* (2013.01); *D01F 4/00* (2013.01); *D01F 9/00* (2013.01); *D01F 9/04* (2013.01); *D10B 2509/022* (2013.01)

(58) Field of Classification Search

None

See application file for complete search history.

(56) References Cited

U.S. PATENT DOCUMENTS

2006/0165836 A1* 7/2006 Vollrath ..... D01D 5/30 425/382 R
2015/0376815 A1* 12/2015 Kotera ..... D01D 4/02 162/157.4

FOREIGN PATENT DOCUMENTS

CN 102560787 * 5/2014
CN 103225118 * 7/2015

* cited by examiner

*Primary Examiner* — Nathan T Leong
(74) *Attorney, Agent, or Firm* — Winston Hsu

(57) ABSTRACT

The present application provides a manufacturing method and a spinneret assembly that includes a nozzle body, an outer spinning solution channel formed inside the nozzle body, and at least one inner spinning solution channel formed inside the nozzle body. A nozzle outlet formed at an end of the nozzle body is immersed in a solidification liquid. The outer spinning solution channel includes an outer liquid outlet, and the at least one inner spinning solution channel includes an inner liquid outlet. The outer liquid outlet and the inner liquid outlet communicate with the nozzle outlet and are confluent at the nozzle outlet. A diameter of the inner liquid outlet is smaller than a diameter of the outer liquid outlet. An outer-layer dope spinned from the outer liquid outlet covers an inner-layer dope spinned from the inner liquid outlet so as to generate a solid filamentary fiber with multi-layer materials.

10 Claims, 3 Drawing Sheets

(51) Int. Cl.

| | |
|---|---|
| *D01F 9/04* | (2006.01) |
| *D01F 9/00* | (2006.01) |

SPINNERET ASSEMBLY FOR COMPOSITE SPINNING AND MANUFACTURING METHOD FOR A BIOMASS COMPOSITE FIBER IMPLEMENTING THE SAME

BACKGROUND OF THE INVENTION

1. Field of the Invention

The invention relates to a spinneret assembly and a manufacturing method, and more particularly, to a spinneret assembly for biomass composite spinning and a manufacturing method utilizing the spinneret assembly to manufacture a biomass composite fiber.

2. Description of the Prior Art

The technologies of wound dressings have grown mature, and the functions of wound dressings are becoming more and more powerful. Conventional raw materials used in bi-component or multi-component biomass composite spinning are biomass materials such as alginate, chitin, chitosan and collagen, and conventional manufacturing methods can be categorized into the following types: 1. directly blending different biomass materials before spinning and solidification, 2. preparing a yarn made of one biomass material and then immersing the yarn into a solution made of another biomass material to cover the yarn by reaction, and 3. physically twisting and intertwining yarns of different biomass materials into a single yarn. However, all the aforementioned methods have problems such as non-uniformly distributed fiber components, weak fiber strength, and slow formation speed, which are unfavorable to mass production of multi-component biomass composite yarns with good quality.

The Chinese patent with publication number CN102560787 discloses a manufacturing method for a bi-component composite fiber, where two component polymeric substances are respectively fused, spinned, cooled, and oiled before being physically and compositely intertwined together for coiling. However, the method disclosed by CN102560787 utilizes high temperature for fusing, and the high temperature is unsuitable for temperature-sensitive spinning biomass materials. Physically forcing biomass material fibers to intertwine together also produces poor bonding strength. Another Chinese patent with publication number CN103225118 discloses a side-by-side composite fiber spinneret plate, which also utilizes high temperature (above 255° C.) for fusing. The high fusing temperature is harmful to biomass materials because overly raised temperature might damage the biomass spinning fiber and lose utility thereof. Another Chinese patent with publication number CN104284710 discloses a manufacturing method for a porous hollow fiber membrane, and the objective of the method is not to manufacture a solid filamentary yarn but a hollow cylinder fiber membrane, which thereby is incapable of manufacturing a solid multi-component biomass spinning yarn. Another Chinese patent with publication number CN105063778 discloses a spinning nozzle for spinning hollow fiber membrane, and the objective of the disclosure is also to manufacture a hollow cylinder fiber membrane, which thereby is incapable of manufacturing a solid multi-component biomass spinning yarn.

SUMMARY OF THE INVENTION

To solve the aforementioned problems, an embodiment of the present application provides a spinneret assembly for composite spinning and a manufacturing method utilizing the spinneret assembly to manufacture a biomass composite fiber, wherein the manufacturing method can be a wet spinning process for manufacturing the multi-component biomass composite fiber. The present application provides manufacturing the biomass composite fiber with two or more components in one step and solves the conventional problems of non-uniformly distributed fiber components, weak fiber strength, and slow formation speed.

The spinneret assembly provided by the embodiment of the present application includes a nozzle body, an outer spinning solution channel formed inside the nozzle body, and at least one inner spinning solution channel formed inside the nozzle body. A nozzle outlet is formed at an end of the nozzle body and is immersed in a solidification liquid completely. The outer spinning solution channel includes an outer liquid outlet communicated with the nozzle outlet. The at least one inner spinning solution channel includes an inner liquid outlet communicated with the nozzle outlet. The outer liquid outlet and the inner liquid outlet are confluent at the nozzle outlet. A diameter of the inner liquid outlet is smaller than a diameter of the outer liquid outlet. An outer-layer fiber spinned from the outer liquid outlet covers an inner-layer fiber spinned from the inner liquid outlet so as to generate a solid filamentary fiber with multi-layer materials.

In the spinneret assembly provided by the embodiment of the present application, the nozzle body is made of stainless steel.

In the spinneret assembly provided by the embodiment of the present application, the solidification liquid is an aqueous calcium chloride solution.

In the spinneret assembly provided by the embodiment of the present application, the outer-layer fiber is made of alginate.

In the spinneret assembly provided by the embodiment of the present application, the inner-layer fiber is made of chitin or collagen.

An embodiment of the present application further provides the manufacturing method for the biomass composite fiber which includes the following steps: providing the spinneret assembly, providing at least two biomass spinning solutions in a feeding bucket for allowing the spinneret assembly to generate the solid filamentary fiber with the multi-layer materials in a solidification tank, transporting the solid filamentary fiber in the solidification tank to a cleaning tank for cleaning, transporting the cleaned solid filamentary fiber to a heating roller apparatus for heating, and coiling the solid filamentary fiber with a coiling apparatus. The spinneret assembly communicates with the feeding bucket. The nozzle outlet of the nozzle body is immersed in the solidification liquid in the solidification tank.

In the manufacturing method provided by the embodiment of the present application, the biomass composite fiber is made of at least one of alginate, chitin, and collagen.

The manufacturing method provided by the embodiment of the present application further includes the following step: cleaning the solid filamentary fiber with a cleaning liquid made of at least one of water and alcohol and stored in the cleaning tank.

The manufacturing method provided by the embodiment of the present application further includes the following step: heating the cleaned solid filamentary fiber with a heating temperature of the heating roller apparatus lower than or equal to 50° C.

In summary, the present application provides the spinneret assembly and the manufacturing method utilizing the spinneret assembly for manufacturing the multi-component biomass composite fibers and thereby solves the conventional problems of non-uniformly distributed fiber components, weak fiber strength, and slow formation speed, which are presented in the conventional manufacturing method. Therefore, the present application can efficiently and steadily spin the multi-component biomass composite fibers with uniformly distributed components and high strength. The present application further presents versatility for application, with an ability to manufacture different types of biomass composite fibers with components like alginate, chitin (i.e. chitosan), or collagen.

These and other objectives of the present invention will no doubt become obvious to those of ordinary skill in the art after reading the following detailed description of the preferred embodiment that is illustrated in the various figures and drawings.

DETAILED DESCRIPTION

These and other objectives of the present invention will no doubt become obvious to those of ordinary skill in the art after reading the following detailed description of the preferred embodiment that is illustrated in the various figures and drawings.

Biomass materials used in current medical wound dressings have various characteristics and purposes. Alginate, such as sodium alginate, has high hydrophilicity and high water-absorbency (by absorbing water to up to 20 times of the deadweight of the alginate), and thereby gel made of alginate can preserve nutrient infusion for cell proliferation and for improving formation of epidermis and granulation tissue. Compared with other biomass materials, such as chitin, chitosan, and collagen, alginate fiber has the advantages of high formation speed, high spinning efficiency, and high fiber strength. Positive charge can be dissociated from chitosan fiber when the chitosan fiber is in contact with tissue fluid or blood, and the positive charge can break down cell wall of bacteria so as to achieve sterilization. The dissociated positive charge can also attract negative-charged thrombocyte to form thrombus for quick hemostasis at the location of a wound. Serving to bind tissue, collagen found in animal cells can be applied to hemostasis, nerves reconstruction, tissue shaping, burns treatment, hernia repair, urethra surgery, drug release regulation, ophthalmic procedure, vaginal contraceptives, cardiac valve repair, vascular wall surgery, surgical sutures, or other related biomedical materials. A trend of today's biomedical material dressings is to combine multiple biomass materials for adopting and exploiting the versatile characteristics. However, a conventional manufacturing method for a multi-component biomass composite fiber has problems such as non-uniformly distributed fiber components, weak fiber strength, and slow formation speed, which are unfavorable to mass production of the multi-component biomass composite fibers with good quality and low cost. Therefore, the present application provides a spinneret assembly which efficiently and steadily spins the bi-component or multi-component biomass composite fibers. Inventive features and advantages of the present application are presented through the following embodiments of the present application.

Figure 1:
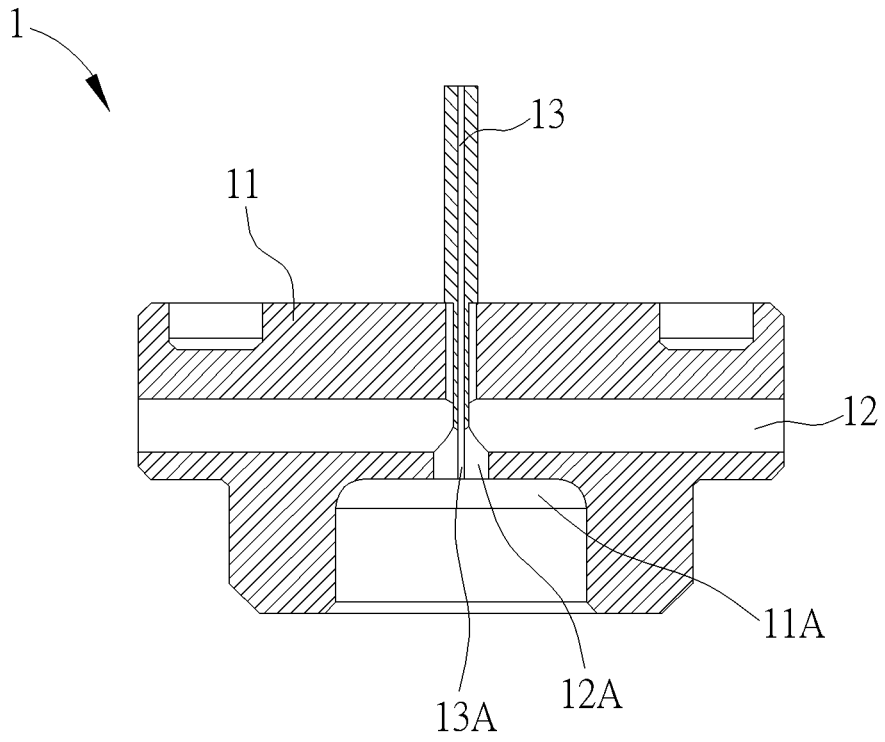
FIG. 1 is a structural diagram of a spinneret assembly according to a first embodiment of the present application.
Figure 2:
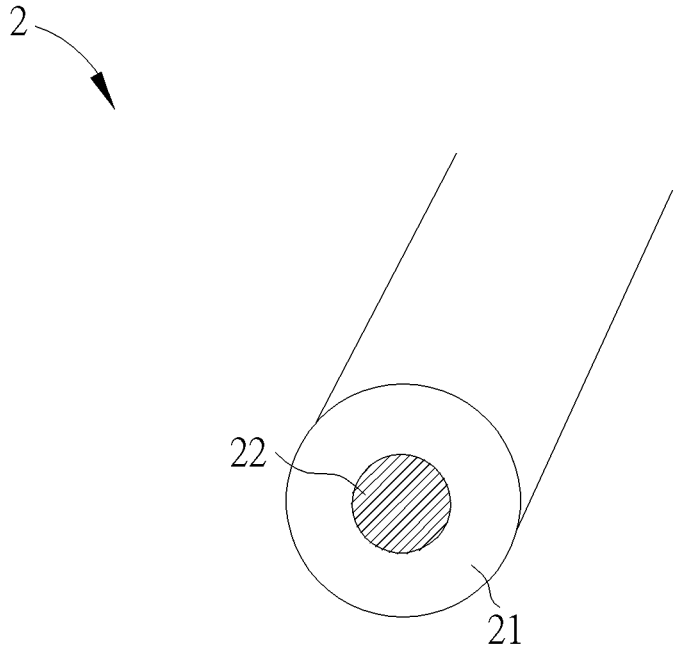
FIG. 2 is a diagram of a bi-layer biomass composite fiber spinned by the spinneret assembly according to the first embodiment of the present application.

Please refer to FIG. 1 and FIG. 2. FIG. 1 is a structural diagram of the spinneret assembly 1 according to a first embodiment of the present application. FIG. 2 is a diagram of a bi-layer biomass composite fiber 2 spinned by the spinneret assembly 1 according to the first embodiment of the present application. The spinneret assembly 1 includes an outer spinning solution channel 12 and an inner spinning solution channel 13 formed inside a nozzle body 11 of the spinneret assembly 1. An outer liquid outlet 12A of the outer spinning solution channel 12 and an inner liquid outlet 13A of the inner spinning solution channel 13 are confluent at the nozzle outlet 11A. As shown in FIG. 1, since the outer liquid outlet 12A surrounds the inner liquid outlet 13A, an inner-layer dope spinned from the inner liquid outlet 13A can be completely covered by an outer-layer dope spinned from the outer liquid outlet 12A when spinning solutions are simultaneously pressurized and spinned out of the outer spinning solution channel 12 and the inner spinning solution channel 13. The spinned dopes combine to form a bi-layer solid filamentary spinning dope, which is spinned out of the nozzle outlet 11A and into a solidification tank outside of the nozzle outlet 11A. Through proton exchange between the filamentary spinning dope and a solidification liquid, such as a calcium chloride ($CaCl_2$) aqueous solution, in the solidification tank, the filamentary spinning dope is converted into a gel state and then shaped into a fiber before being cleaned by water. The gel-like fiber is cleaned by water and then hot-drawn and elongated for undergoing synaeresis to form as an as-spun fiber with low fluidity. The as-spun fiber is coiled by a coiling apparatus and ready for being used as the biomass composite fiber 2. It is noticed that components of the solidification liquid can be varied according to the prepared biomass materials, and the description of the exemplary embodiment is intended to be illustrative and not to limit the scope of the invention.

Please refer to FIG. 1 and FIG. 2. An outer-layer fiber 21 is formed from the outer-layer dope spinned from the outer liquid outlet 12A and covers an inner-layer fiber 22 formed from the inner-layer dope spinned from the inner liquid outlet 13A, so as to generate the solid filamentary fiber 2 with two materials. For example, the outer-layer fiber 21 can be made of the alginate. The inner-layer fiber 22 can be made of chitin (or chitosan). The bi-layer structure of the solid filamentary fiber 2 enables exploiting effects of the alginate and the chitin respectively. In the spinning process, the alginate has the advantages of high formation speed, high spinning efficiency, and high fiber strength compared with the other biomass materials. Therefore, the alginate can be utilized as an outer layer of the biomass composite fiber 2 so as to cover the other biomass materials. In contrast to composite fibers produced with conventional methods by immersing a spinned fiber for blending or by physically intertwining fibers, a cross section of the biomass composite fiber 2 produced by the present application bears uniformly distributed components.

Figure 3:
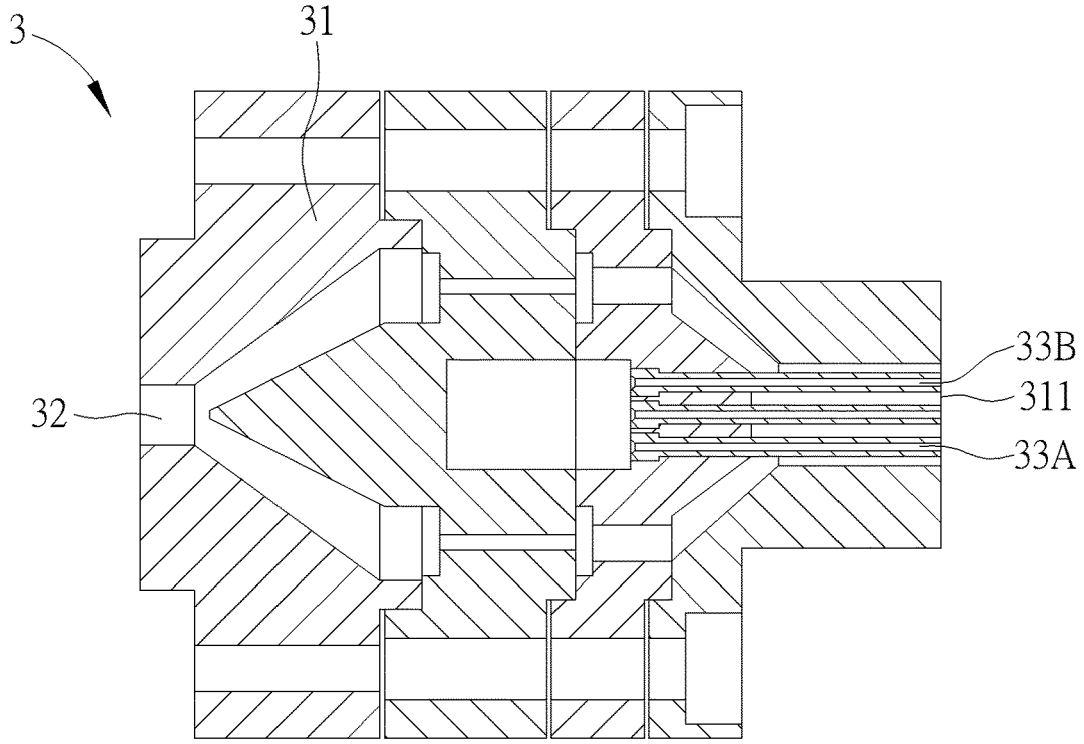
FIG. 3 is a structural diagram of a spinneret assembly according to a second embodiment of the present application.
Figure 4:
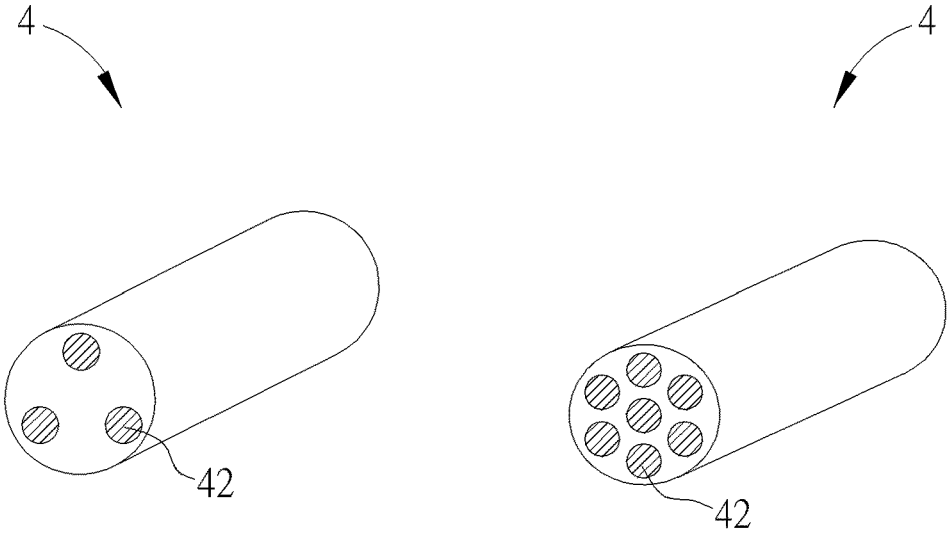
FIG. 4 is a sectional diagram of a multi-component biomass composite fiber spinned by the spinneret assembly according to another embodiment of the present application.

By increasing the number of the inner spinning solution channels, the spinneret assembly of the present application can produce a biomass composite fiber with more than two components, which is a biomass composite fiber with multiple threads of inner-layer fibers covered by an outer-layer fiber. Please refer to FIG. 3. FIG. 3 is a structural diagram of a spinneret assembly 3 according to a second embodiment of the present application. The spinneret assembly 3 includes a nozzle body 31 in form of an assembly, an outer spinning solution channel 32 and a plurality of inner spinning solution channels 33A, 33B. A diameter of the outer spinning solution channel 32 is larger than diameters of the inner spinning solution channels 33A, 33B. Liquid outlets of the inner spinning solution channels 33A, 33B are encompassed by an liquid outlet of the outer spinning solution channel 32, and the liquid outlets of the inner spinning solution channels 33A, 33B and the liquid outlet of the outer spinning solution channel 32 are confluent at a nozzle outlet 311 of the nozzle body 31. Therefore, the inner-layer dopes spinned from the inner spinning solution channels 33A, 33B can be directly covered by the outer-layer dope spinned from the outer spinning solution channel 32 so as to form the biomass composite fiber with uniformly distributed components. Please refer to FIG. 4. FIG. 4 is a sectional diagram of a multi-component biomass composite fiber 4 spinned by the spinneret assembly 3 according to the second embodiment of the present application. The number of inner-layer fibers 42 can be, but is not limited to, three or seven, and the respective materials of the inner-layer fibers 42 can be the same or can be different.

Figure 5:
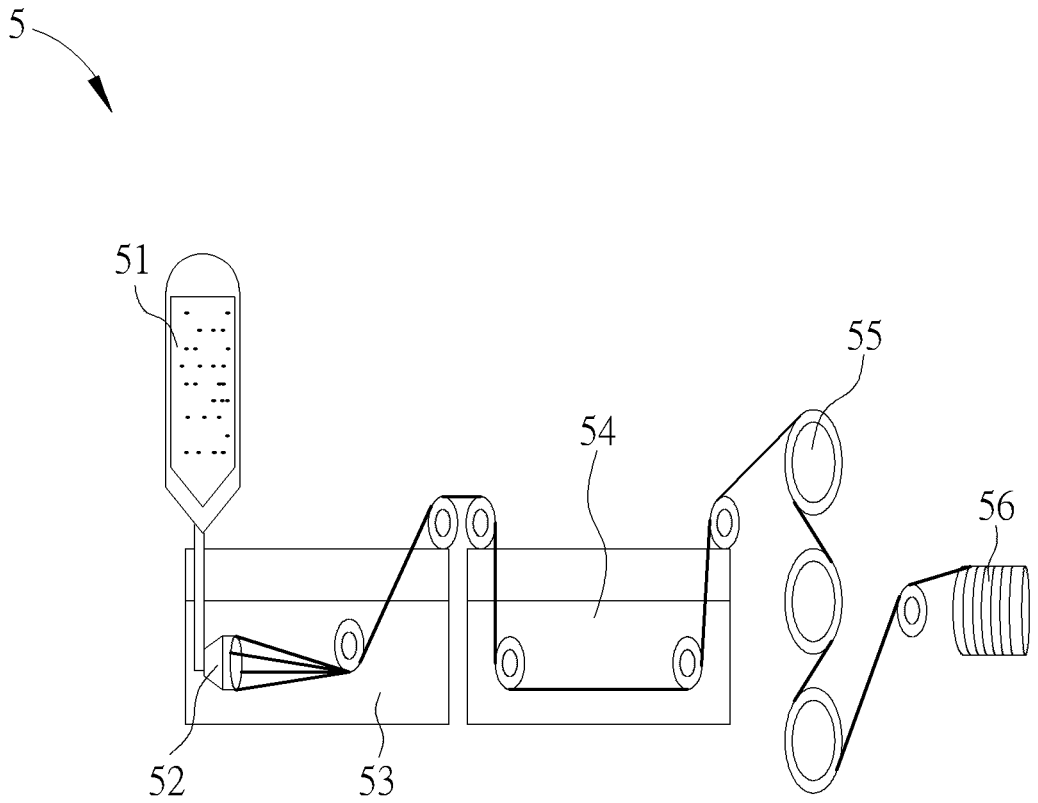
FIG. 5 is a diagram of a manufacturing system for manufacturing the biomass composite fiber spinned by the spinneret assembly of the present application.

Please refer to FIG. 5. FIG. 5 is a diagram of a manufacturing system 5 for manufacturing the biomass composite fiber spinned by a spinneret assembly 52 of the present application. The manufacturing system 5 includes a feeding bucket 51, the spinneret assembly 52, a solidification tank 53, a cleaning tank 54, a heating roller apparatus 55, and a coiling apparatus 56. The feeding bucket 51 is for containing one or more than one kind of biomass spinning solution and providing the biomass spinning solutions for the spinneret assembly 52 immersed in the solidification tank 53, wherein the different biomass spinning solutions can also be respectively contained in a plurality of feeding buckets 51. The manufacturing system 5 can be implemented with a wet spinning process. The biomass materials, such as the alginate, the chitin, or the collagen, cannot be processed by high temperature, which might damage components of the biomass materials. Therefore, the biomass composite fiber cannot be formed by a conventional fusion spinning process, that is, the biomass materials are heated to a fused (i.e. molten) state and spinned before being cooled for shaping. The manufacturing system 5 of the present application directly transports the filamentary spinning dope pressurized and spinned from the spinneret assembly 52 into the solidification tank 53, and the filamentary spinning dope undergoes the proton exchange with the calcium chloride ($CaCl_2$) aqueous solution in the solidification tank 53 so that the biomass materials contained in the filamentary spinning dope can be converted into the gel state and shaped into the gel-like fiber. The gel-like fiber is transported to the cleaning tank 54 and then cleaned to remove excess solidification liquid on the gel-like fiber. A cleaning liquid in the cleaning tank 54 can be pure water (i.e. distilled water), ethanol (i.e. alcohol), or a mixture of the pure water and the ethanol in particular proportion (i.e. an ethanol aqueous solution). The ethanol theoretically has better cleaning effect, but the pure ethanol is highly volatile and with a production cost higher than the pure water. Therefore, the mixture of the pure water and the ethanol is adopted as the cleaning liquid for a preferred embodiment in practical application. The cleaned gel-like fiber is heated by the heating roller apparatus 55 to remove excess cleaning liquid (i.e. water or ethanol) on the gel-like fiber. It should be noticed that heating temperature of the heating roller apparatus 55 cannot be too high, or the components of the biomass materials might be damaged. According to a preferred embodiment, the heating temperature of the heating roller apparatus 55 can be equal to or lower than 50° C. The heated and dried fiber is coiled by the coiling apparatus 56 into a coil for use in biomedical wound dressings or in spinning equipment with other utility.

In summary, the present application provides the spinneret assembly and the manufacturing method utilizing the spinneret assembly for manufacturing the multi-component biomass composite fibers and thereby solves the conventional problems of non-uniformly distributed fiber components, weak fiber strength, and slow formation speed, which are presented in the conventional manufacturing method. Therefore, the present application can efficiently and steadily spin the multi-component biomass composite fibers with uniformly distributed components and high strength. The present application further presents versatility for application, with an ability to manufacture different types of biomass composite fibers with components like alginate, chitin (i.e. chitosan), or collagen.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A spinneret assembly for composite spinning, the spinneret assembly comprising:

a nozzle body, a nozzle outlet being formed at an end of the nozzle body, the nozzle outlet being immersed in a solidification liquid completely;

an outer spinning solution channel formed inside the nozzle body, the outer spinning solution channel comprising an outer liquid outlet communicated with the nozzle outlet; and at least one inner spinning solution channel formed inside the nozzle body, the at least one inner spinning solution channel comprising an inner liquid outlet communicated with the nozzle outlet;

wherein the outer liquid outlet and the inner liquid outlet are confluent at the nozzle outlet, a diameter of the inner liquid outlet being smaller than a diameter of the outer liquid outlet, and an outer-layer fiber formed from an outer-layer dope spinned from the outer liquid outlet covers an inner-layer fiber formed from an inner-layer dope spinned from the inner liquid outlet so as to generate a solid filamentary fiber with multi-layer materials.

2. The spinneret assembly of claim 1, wherein the nozzle body is made of stainless steel.

3. The spinneret assembly of claim 1, wherein the solidification liquid is an aqueous calcium chloride solution.

4. The spinneret assembly of claim 1, wherein the outer-layer fiber is made of alginate.

5. The spinneret assembly of claim 1, wherein the inner-layer fiber is made of chitin or collagen.

6. A manufacturing method for a biomass composite fiber, the method comprising:

providing the spinneret assembly of claim 1, the spinneret assembly communicating with a feeding bucket, the nozzle outlet of the nozzle body being immersed in the solidification liquid in a solidification tank;

providing at least two biomass spinning solutions in the feeding bucket for allowing the spinneret assembly to generate the solid filamentary fiber with the multi-layer materials in the solidification tank;

transporting the solid filamentary fiber in the solidification tank to a cleaning tank for cleaning;

transporting the cleaned solid filamentary fiber to a heating roller apparatus for heating; and coiling the solid filamentary fiber with a coiling apparatus.

7. The manufacturing method of claim 6, wherein the solidification liquid is an aqueous calcium chloride solution.

8. The manufacturing method of claim 6, wherein the biomass spinning solutions is made of at least one of alginate and chitin and collagen.

9. The manufacturing method of claim 6, further comprising cleaning the solid filamentary fiber with a cleaning liquid made of at least one of water and ethanol and stored in the cleaning tank.

10. The manufacturing method of claim 6, further comprising heating the cleaned solid filamentary fiber with a heating temperature of the heating roller apparatus lower than or equal to 50° C.

* * * * *